United States Patent [19]

Saarem et al.

[11] Patent Number: 4,650,118

[45] Date of Patent: Mar. 17, 1987

[54] POP-UP GEAR DRIVEN SPRINKLER HEAD

[75] Inventors: Myrl J. Saarem; Donald E. Lovelace, both of Carson City, Nev.

[73] Assignee: Richdel Div. of Garden America Corp., Oakland, Calif.

[21] Appl. No.: 747,881

[22] Filed: Jun. 24, 1985

[51] Int. Cl.[4] ..... B05B 3/04

[52] U.S. Cl. ..... 239/206; 239/241; 74/116; 74/157

[58] Field of Search ..... 239/204, 206, DIG. 1, 239/240–242; 74/116, 118, 157

[56] References Cited

U.S. PATENT DOCUMENTS

| | | | |
|---|---|---|---|
| 3,035,778 | 5/1962 | Kimbro et al. | 239/242 X |
| 3,038,666 | 6/1962 | Dudley et al. | 239/242 X |
| 3,312,113 | 4/1967 | Mortini | 239/241 X |
| 3,921,912 | 11/1975 | Hayes | 239/DIG. 1 X |
| 4,417,691 | 11/1983 | Lockwood | 239/241 X |
| 4,540,125 | 9/1985 | Gorney et al. | 239/DIG. 1 |

FOREIGN PATENT DOCUMENTS

| | | | |
|---|---|---|---|
| 679142 | 1/1964 | Canada | 239/242 |
| 2209998 | 9/1973 | Fed. Rep. of Germany | 239/DIG. 1 |

*Primary Examiner*—Joseph F. Peters, Jr.
*Assistant Examiner*—Kevin Weldon
*Attorney, Agent, or Firm*—Keith D. Beecher

[57] ABSTRACT

A gear driven sprinkler head with a pop-up spray nozzle driven by a water-flow powered motor. The nozzle is rotated incrementally through an adjustable arc to irrigate a sector of a particular size, and it is automatically reversed at the end points of the selected irrigated sector. The nozzle may be interchanged with other nozzles to provide matched precipitation rates for sectors of different sizes. The feature of incremental rotation of the nozzle overcomes the problem of reduced throw distance at high rotational speeds encountered by the prior art assemblies of the same general type.

6 Claims, 7 Drawing Figures

POP-UP GEAR DRIVEN SPRINKLER HEAD

BACKGROUND OF THE INVENTION

Sprinkler heads with rotatable pop-up nozzles propelled by water pressure are presently in widespread use. These heads which are capable of discharging relatively large volumes of water over large areas so as to minimize the number of heads required, for example, on golf courses, large expanses of grass, cultivated areas, and the like. Many types of self-propelled sprinkler heads are known to the art.

A principal objective of the present invention is to provide an improved sprinkler head having a self-propelled pop-up rotatable nozzle which rotates incrementally in a stop-and-go manner in alternate clockwise and counterclockwise directions through an adjustable arc. As mentioned above, the incremental movement of the nozzle overcomes the problem of reduced water throw distance encountered in the prior art assemblies in which the nozzles are rotatably driven in a continuous manner.

Another objective of the sprinkler head of the present invention is to provide an improved and simplified means whereby the effective irrigating arc of the sprinkler head may be easily adjusted.

DETAILED DESCRIPTION OF THE ILLUSTRATED EMBODIMENT

Figure 1:
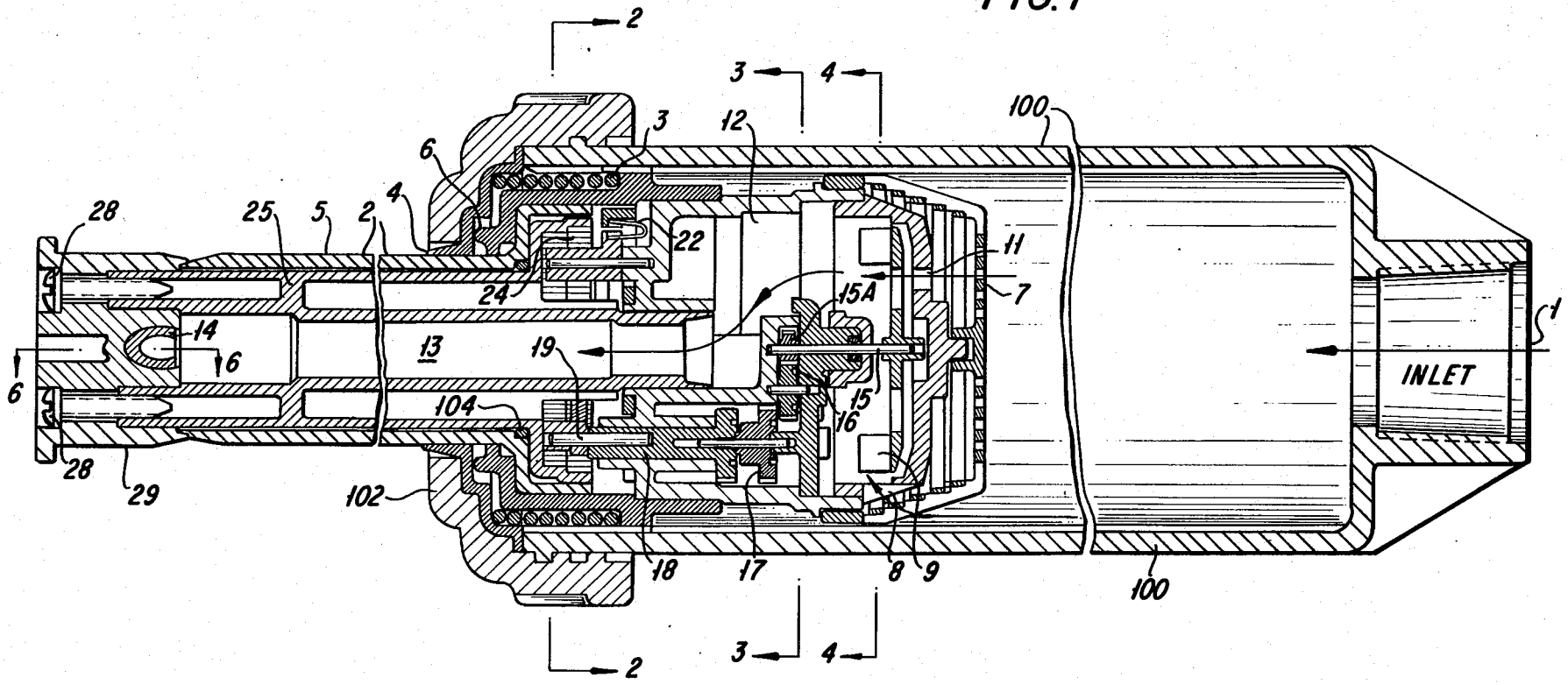
FIG. 1 is a side sectional view of a sprinkler head constructed in accordance with the present invention in one of its embodiments.
Figure 1A:
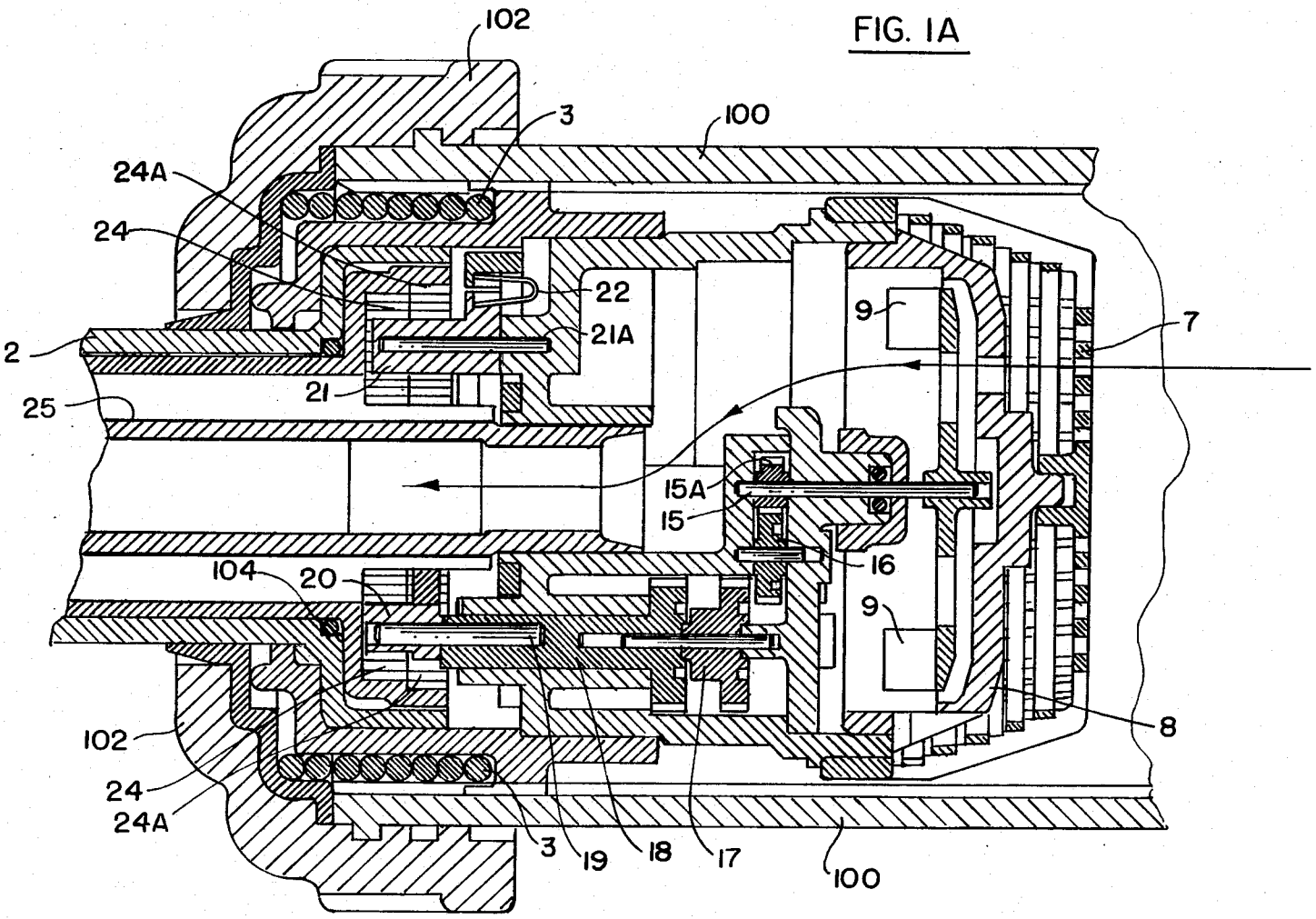
FIG. 1A is a side sectional view, like FIG. 1, of a portion of the sprinkler head on a somewhat enlarged scale with respect to FIG. 1.

The sprinkler head assembly shown in FIG. 1 and FIG. 1A inclues a tubular housing 100 having an inlet 1 at one end thereof through which water under pressure is introduced into the interior of housing 100. A poppet assembly designated generally as 2 is coaxially mounted within the tubular housing 100 for axial movement within the housing from a retracted position to an operational position. The poppet assembly in the operational position protrudes through a central opening in a cap 102, the cap being attached to the other end of the housing. The poppet assembly is spring-biased to its retracted position by a spring 3, and it is forced into its illustrated operational position by the pressure of the water introduced into the housing 100 through the inlet 1. The poppet assembly 2 includes an outer tubular riser 5, and an inner tubular riser 25, the risers being mounted coaxially with one another, and which are sealed to one another by an O-ring 104.

A water driven motor including a stator 8 and a rotor 9, is mounted on the internal end of the poppet assembly. Water is introduced into the motor through a screen filter 7 and the water passes through the motor, and through an internal axial passage 13 in the inner riser 25, to a nozzle assembly 29. The nozzle assembly

Figure 3:
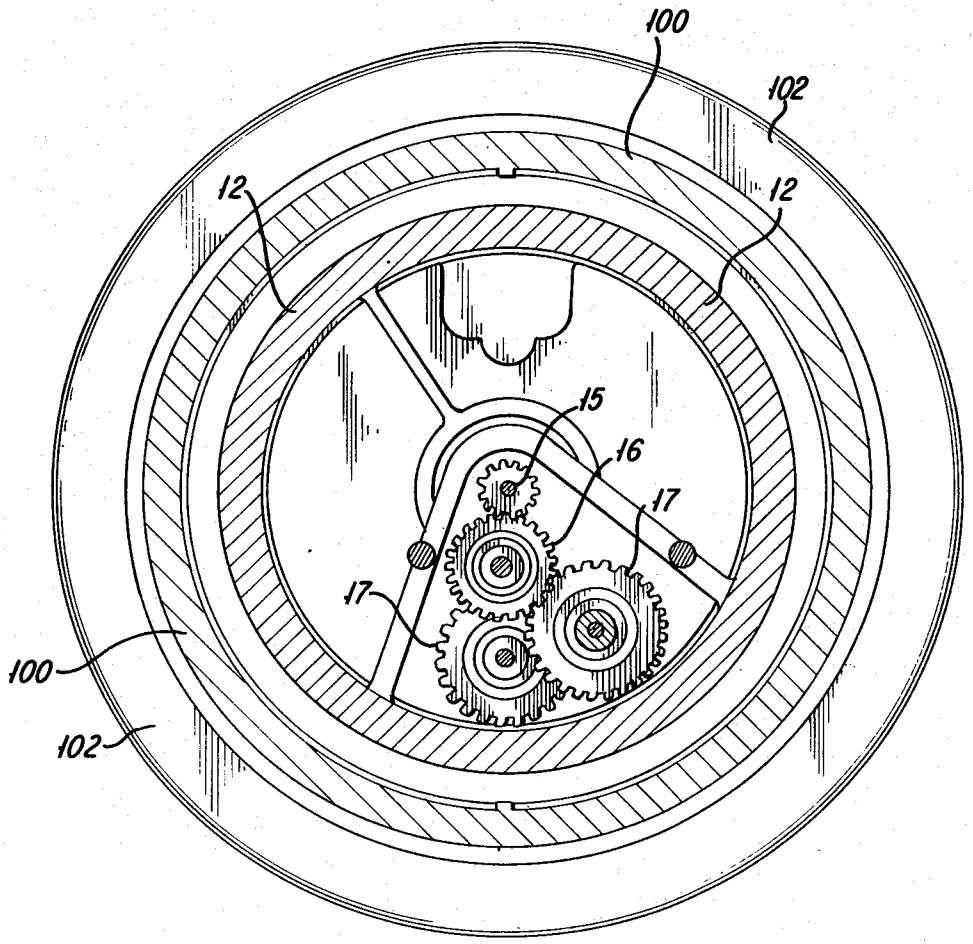
Figure 4:
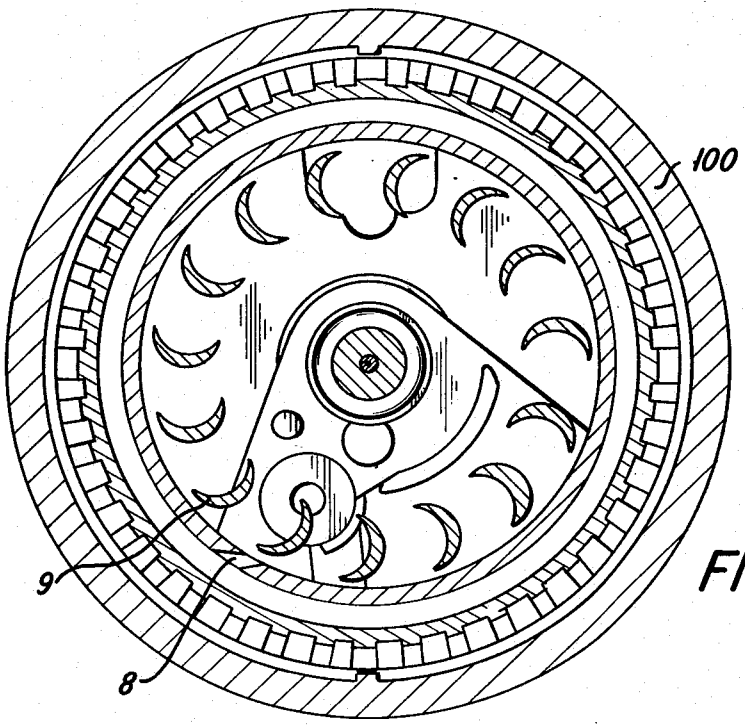
Figure 6:
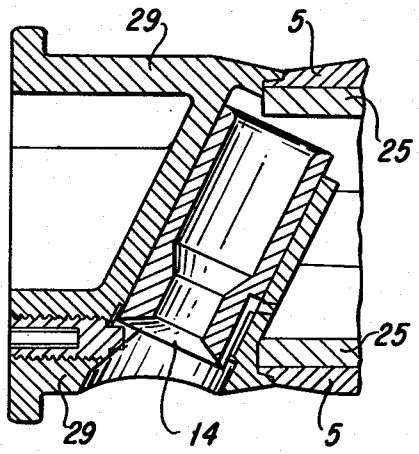
FIG. 6 is a section taken along the line 6—6 of FIG. 1.

29 is mounted on the end of the inner riser by screws 28. The nozzle assembly includes a nozzle 14, as shown in FIG. 6. Rotor 9 of the motor is coupled through a drive shaft 15 to a pinion 15A. Pinion 15A drives an idler gear 16, which, in turn, drives an output shaft 18 through a series of reduction gears 17 (FIG. 3). As shown in FIG. 4, the rotor 9 has a series of rotor blades against which the incoming water is directed, to cause the rotor to rotate.

Figure 2:
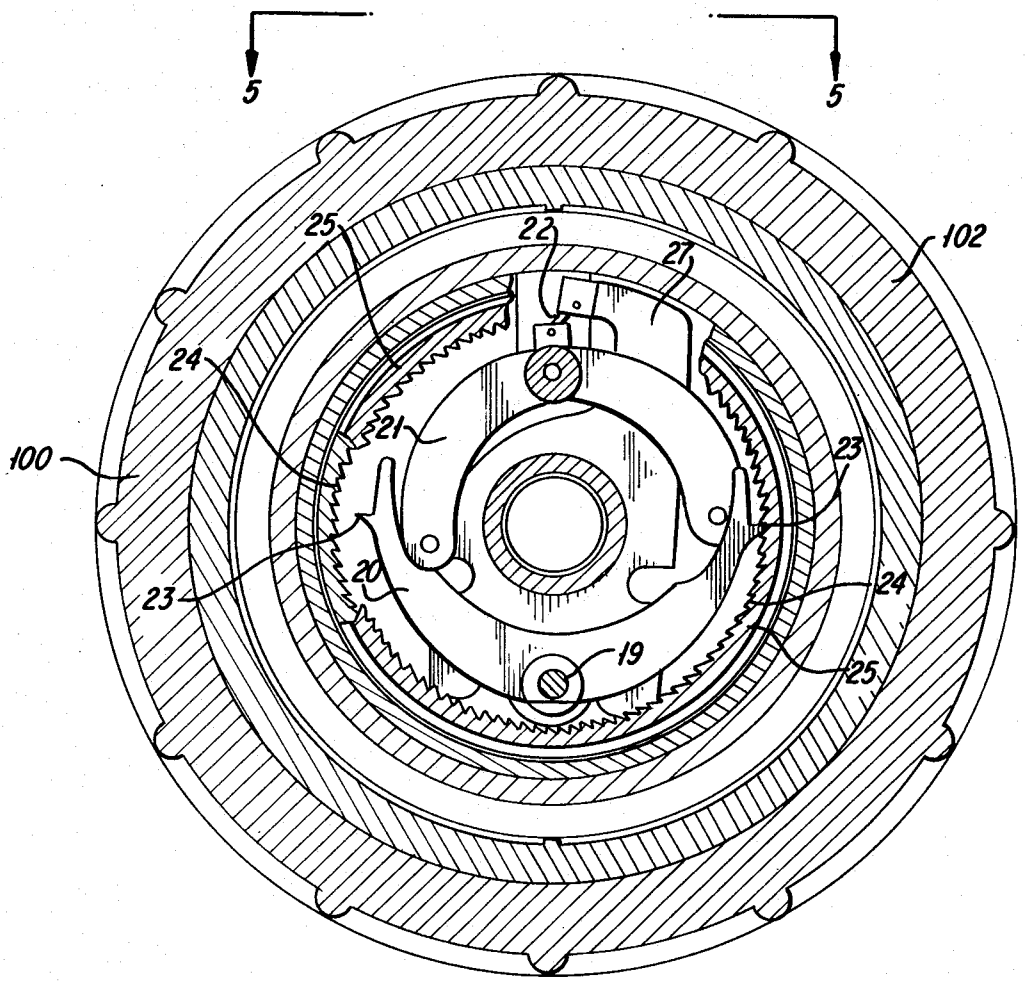
FIGS. 2, 3 and 4 are cross-sectional views of the assembly of FIG. 1 taken essentially along the lines 2—2, 3—3 and 4—4 respectively.

The gears 15A, 16 and 17 are contained in a gear box mounted on the end of the poppet assembly. The output shaft 18 drives an axial eccentric pin 19 which operates a pawl 20 which is mounted on a pin 21A (FIG. 2). The pawl has a tooth 23 at each of its extremities, as shown in FIG. 2. Each tooth 23 selectively engages a first and a second adjacent sets of oppositely oriented sawtooth recesses 24, 24A formed on the inner perimeter of the inner riser 25.

Figure 5:
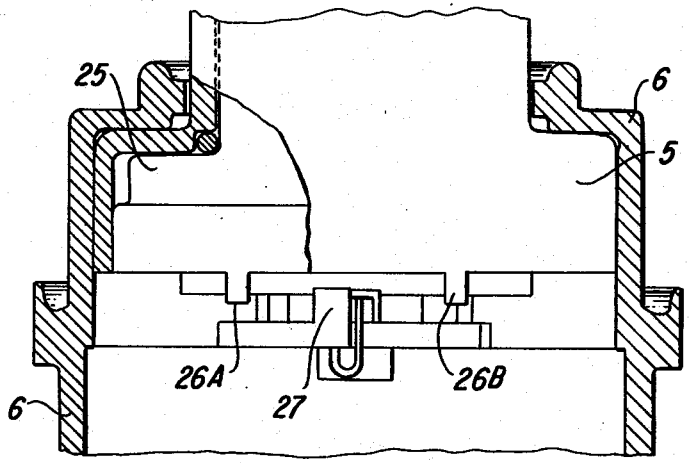
FIG. 5 is a view taken approximately along the lines 5—5 of FIG. 2.

The pawl is lightly spring loaded by a pivotally mounted follower 21, which is shifted between two angular positions by a shifter 27 coupled to an over-center shifter spring 22. The shifter 27 is operated to a first position by a trip tab 26A (FIG. 5) mounted on the inner riser 25, and it is shifted to a second position by a trip tab 26B which is mounted on the outer riser 5.

When water flow is initiated, differential pressure between the inlet 1 and the upper side of the poppet assembly 2, at atmospheric pressure, causes the poppet assembly to overcome the force of spring 3 and to rise to the operational position shown in FIG. 1. There is a minor flow of water through the annulus between the lip of gasket 4 and the outer riser 5 to flush out any foreign matter from that annulus. This flow of water continues until a ridge of the bell housing 6 seals against the inner surface of gasket 4. At this point, the poppet assembly is fully extended in its watering position.

The incoming water now passes through screen filter 7 and through one or more openings in stator 8 to form jets which impacts the rotor blades (FIG. 4) causing the rotor 9 to rotate. To adjust partially the jet-rotor relative velocity when large capacity nozzles are fitted, water is by-passed through one or more orifices 11 in the stator. Water which has driven the rotor, together with any by-pass water enters a plenum chamber 12 which leads to the axial passage 13 through the inner riser 25 and then to nozzle 14 (FIG. 6).

The rotor 9 turns the drive shaft 15 and pinion 15A which, in turn, drives the reduction gears 17 through idler 16. The output shaft 18 is driven, for example, at approximately 1/30th rotor speed. The output shaft 18 runs up through the bulkhead of the gear box containing gears 15A, 16, 17, and it is is topped by the axial eccentric pin 19. Pin 19, as explained above, drives pawl 20 (FIG. 2) which is lightly spring-loaded to one side or the other by follower 21 and shifter spring 22. The eccentric drive cause a reciprocating motion of tooth 23 at each end of each pawl arm. The engagement of one tooth 23 or the other with the sawtooth recesses 24, 24A on the perimeter of the inner riser 25 converts the reciprocating tooth motion to incremental rotation of the poppet assembly.

The adjacent sets of oppositely oriented sawtooth recesses 24, 24A allow the pawl to rotate the poppet assembly 2 in either direction, according to the direction of spring loading. As explained above, trip tabs 26A and 26B (FIG. 5) engage shifter 27 at the end of each cycle. The shifter is rotated in the direction of travel, loading the shifter spring 22 (FIG. 2) between the shifter and follower 21 until the spring goes over center, which moves the follower to load the pawl in the opposite direction. Now the other pawl tooth 23 is engaged in the other set of sawtooth recesses 24, 24A and it drives the poppet assembly 2 in the opposite direction until the shifter is contacted by the other trip tab.

The sprinkled sector can be varied in size from almost zero to a 360° arc. When the screws 28 are loosened, the inner and outer risers 2 and 25 can be rotated with respect to one another to set the angle between the trip tabs 26A and 26B of FIG. 5. In this way, the angle of the irrigated sector may be set. Scale markings may be placed on the nozzle and outer riser so that the assembly may be set to a predetermined sector size.

In place of the orifice 11 in the stator 8, an automatic by-pass check valve may be provided, spring-loaded at 10 psi, for example, to establish a near optimum operating pressure differential for the rotor. The spring-loaded check valve may be provided as an option to prevent the lowest head in the system from draining the lines. This will save water, reduce over-watering of low sections, and keep the surface water from entering the line.

Accordingly, the stream coming from the nozzle is rotated incrementally in a stop and go manner to overcome the problem of reduced water throw distance associated with high rotation speed. Incremental rotation is determined by the configurations of the two series of sawtooth recesses 24, which may be offset by 2°, for example, thereby causing the clockwise increments to split the counterclockwise increments.

The gear box containing the gears 15A, 16 and 17 may be filled with oil or grease. In the event that the seals fail and water enters the gear box, freezing will not cause damage, because the volume of grease or oil already occupies the space within the gear box.

It will be appreciated that while a particular embodiment of the invention has been shown and described, modifications may be made. It is intended in the claims to cover all modifications which come within the spirit and scope of the invention.

I claim:

1. A sprinkler head comprising: a tubular housing having an inlet at one end; a spray assembly mounted within the housing and movable longitudinally with respect to the housing from a retracted position within the housing to an operational position in which the spray assembly protrudes through the other end of the housing to enable the spray assembly to discharge water over a sector to be irrigated in response to water introduced under pressure into the housing through the inlet; said spray assembly including: inner and outer tubular risers slidably and rotatably mounted in said tubular housing in coaxial relationship therewith and with one another; the inner perimeter of the inner end of said inner riser having two oppositely directed adjacent sets of teeth formed thereon; a pawl pivotally mounted on the inner end of said inner riser and movable between first and second angular positions to engage one or the other of said sets of teeth; a reversing assembly pivotally mounted on the inner end of said inner riser and movable between first and second angular positions to cause said pawl to engage one or the other of said sets of teeth; a first trip tab mounted on the inner end of said inner riser for moving said reversing assembly to its first angular position; a second trip tab mounted on the inner end of said outer riser for moving said reversing assembly to its second angular position, said tabs serving to reverse the angular direction of said nozzle assembly at angular positions determined by the relative angular positions of said inner and outer risers; a nozzle mounted at the other end of the risers; means for introducing water from said inlet into the interior of said inner riser to be discharged through the nozzle; a water driven motor mounted in said housing adjacent to said inlet; and coupling means coupling said motor to said pawl to cause the pawl to impart incremental angular motion to said spray assembly in either of two angular directions.

2. The sprinkler head defined in claim 1, and which includes mounting means for mounting said nozzle in engagement with the other ends of said risers to prevent relative axial and angular movement of said risers, and in which said inner tubular riser is rotatable within said outer tubular riser when said mounting means is loosened to establish the angular distance between the first trip tab and the second trip tab thereby to establish the angle of the sector to be irrigated by the nozzle.

3. The sprinkler head defined in claim 1, in which said coupling means includes an eccentrically driven shaft for imparting reciprocating motion to said pawl.

4. The sprinkler head defined in claim 2, in which said nozzle and one of said tubular risers have markings thereon to assist in adjusting the angle beween the trip tabs to a predetermined value.

5. The sprinkler head defined in claim 1, and which includes a retracting spring mounted in said tubular housing and engaging said outer riser to maintain the spray assembly in a retracted position, said spray assembly reacting to water pressure at said inlet to be moved against the force of said spring to its protruding position.

6. The sprinkler head defined in claim 1, and which includes an over-center spring means included in said reversing assembly for holding said reversing assembly in its first and second angular positions.

* * * * *